United States Patent [19]

Tokuno

[11] 4,338,881

[45] Jul. 13, 1982

[54] SYSTEM FOR CONTROLLING WIDTH AND POSITION OF GLUE OR THE LIKE APPLIED TO A ROLL

[75] Inventor: Masateru Tokuno, Nishinomiya, Japan

[73] Assignee: Rengo Kabushiki Kaisha, Osaka, Japan

[21] Appl. No.: 237,412

[22] Filed: Feb. 23, 1981

Related U.S. Application Data

[63] Continuation-in-part of Ser. No. 219,536, Dec. 23, 1980, abandoned, which is a continuation of Ser. No. 65,742, Aug. 10, 1979, abandoned.

[30] Foreign Application Priority Data

Aug. 25, 1978 [JP] Japan ..... 53-117146

[51] Int. Cl.[3] ..... B05C 1/08

[52] U.S. Cl. ..... 118/673; 118/680; 118/249; 118/258

[58] Field of Search ..... 118/673, 249, 258, 259, 118/261, 672, 669, 680

[56] References Cited

U.S. PATENT DOCUMENTS

| | | | |
|---|---|---|---|
| 2,589,966 | 3/1952 | Rullo | 118/249 |
| 3,065,730 | 11/1962 | Lyons | 118/673 |
| 3,284,015 | 11/1966 | King | 118/673 X |
| 3,936,549 | 2/1976 | Kohler et al. | 118/259 X |

FOREIGN PATENT DOCUMENTS

| | | | |
|---|---|---|---|
| 933166 | 8/1963 | United Kingdom | 118/673 |

*Primary Examiner*—John P. McIntosh
*Attorney, Agent, or Firm*—Wenderoth, Lind & Ponack

[57] ABSTRACT

A control system for controlling the width and position of glue, ink or the like applied from a pan to a roll for applying the glue to a running web. Any out-of-trueness of the web or change in its width is detected by sensors and two dams mounted in the pan are moved to new suitable positions by motors actuated in response to a signal from the sensors.

4 Claims, 7 Drawing Figures

SYSTEM FOR CONTROLLING WIDTH AND POSITION OF GLUE OR THE LIKE APPLIED TO A ROLL

This application is a continuation-in-part of application Ser. No. 219,536, filed Dec. 23, 1980, now abandoned, which in turn is a continuation of application Ser. No. 065,742, filed Aug. 10, 1979, now abandoned.

The present invention relates to a control system for automatically controlling the width and position of glue, ink or the like applied to a roll.

In various technological fields, a roll or rolls are used to apply glue, ink, a coating agent or the like to a running web of paper or other material on a corrugating machine, printing machine, coating machine, or the like. In applying glue, ink or the like to a running web by means of a roll, it is necessary that the width and position of application to the roll be adjusted to any change in the web width or any transverse displacement of the web.

On a corrugating machine, for example, after being corrugated by corrugating rolls, a first liner has glue applied to the peaks of its corrugations by means of a glue roll prior to lamination with a further liner. In applying glue to the roll, the width or position of application needs to be adjusted according to any change in the width of the first liner or any transverse movement thereof, respectively.

A glue roll on a corrugating machine is partially immersed in a glue pan in which two dams are spaced from each other a distance substantially equal to a desired width of glue application to avoid the application of glue to unnecessary portions of the roll. The distance between these two dams determines the width and position at which the glue is applied to the roll. The dams are usually plate-like members having a part made of an abrasion-proof material to prevent abrasion due to contact with the outer periphery of the glue roll. The two dams are mounted in the glue pan so as to confine the glue to apply it only to a desired width of the roll. In a conventional machine, these dams are removably mounted in the glue pan by means of bolts and can be moved by hand to positions judged by eye suitable for the new width and/or new position of the liner.

So long as the liner keeps running true or does not change in width, there will be no problem. However, if the liner runs out of true or its width changes during a production run, the conventional arrangement cannot follow such a displacement or width change immediately. This often produces poor corrugated board either because of failure to glue properly the marginal portions of the first liner, or as a result of application of glue to unnecessary portions of the glue roll causing transfer of glue directly to the corrugating rolls. Further, the adjustment of the dam position by visual check is not sufficiently accurate for satisfactory gluing and the manual adjustment of dam position is troublesome.

An object of the present invention is to provide a control system which permits automatic, accurate control of the width and position of application of glue or the like to a roll.

These objects are achieved according to the present invention by the provision of apparatus for controlling the width and position of application of liquid material such as glue or the like from a pan containing the material to a roll immersed in said pan so that the roll can apply the material to a running web, said apparatus comprising: a pair of dams for immersion in the material in said pan for confining the material in the pan between said dams, the roll being across said dams and extending below the level of the tops of the dams, said dams being movable in said pan in the direction of the length of said roll; sensor means for sensing any displacement of said running web laterally thereof or a change in the width thereof; a pair of reversible motors connected to said sensor means and actuated in response to the sensing by said sensor means of a displacement or change in width of the running web; and a threaded shaft and nut means coupled between each motor and a corresponding dam and said motors being connected thereto for producing relative rotation of said threaded shaft and nut means for moving the corresponding dam to a new position according to the displacement or change in width of the running web.

Other objects and advantages of the present invention will become apparent from the following description taken with reference to the accompanying drawings, in which.

Figure 3:
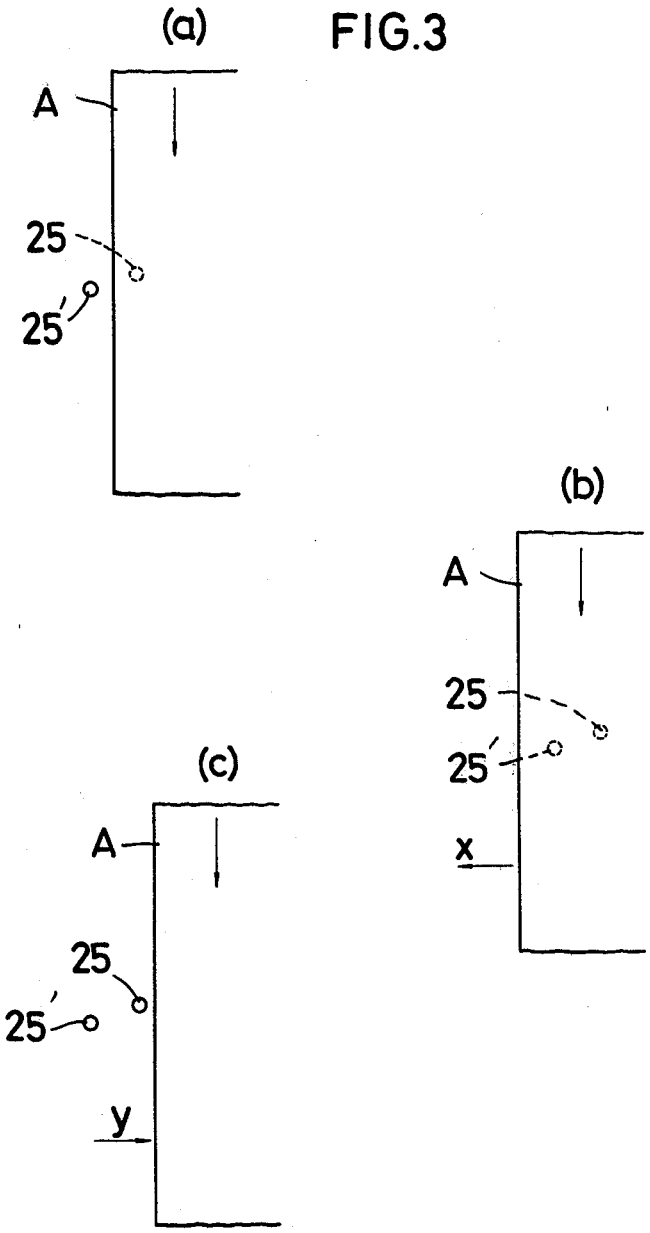
Figure 4:
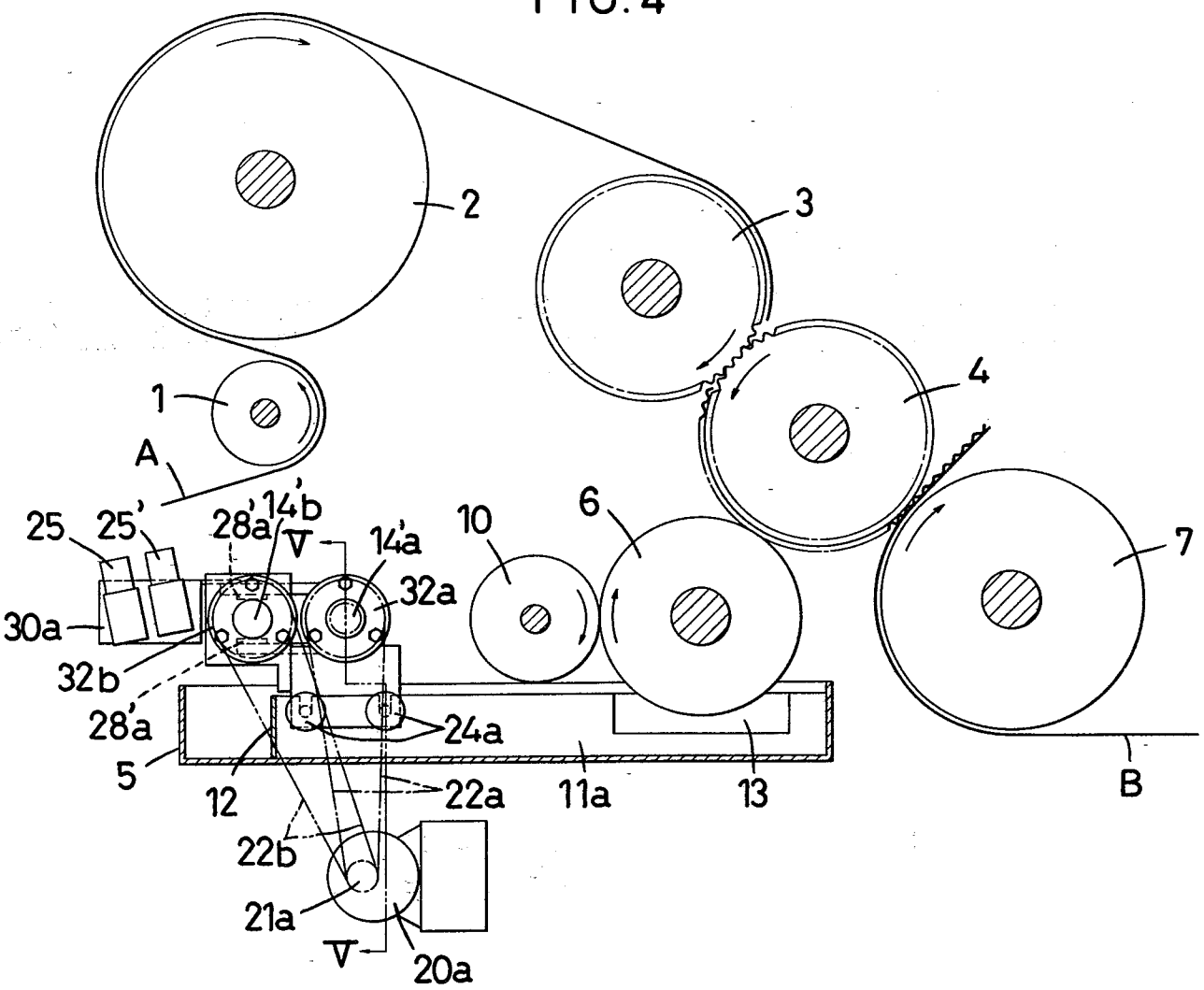

FIGS. 3(*a*), (*b*) and (*c*) are views showing how the displacement of the running web is detected;

FIG. 4 is a schematic view of a second embodiment; and

Figure 5:
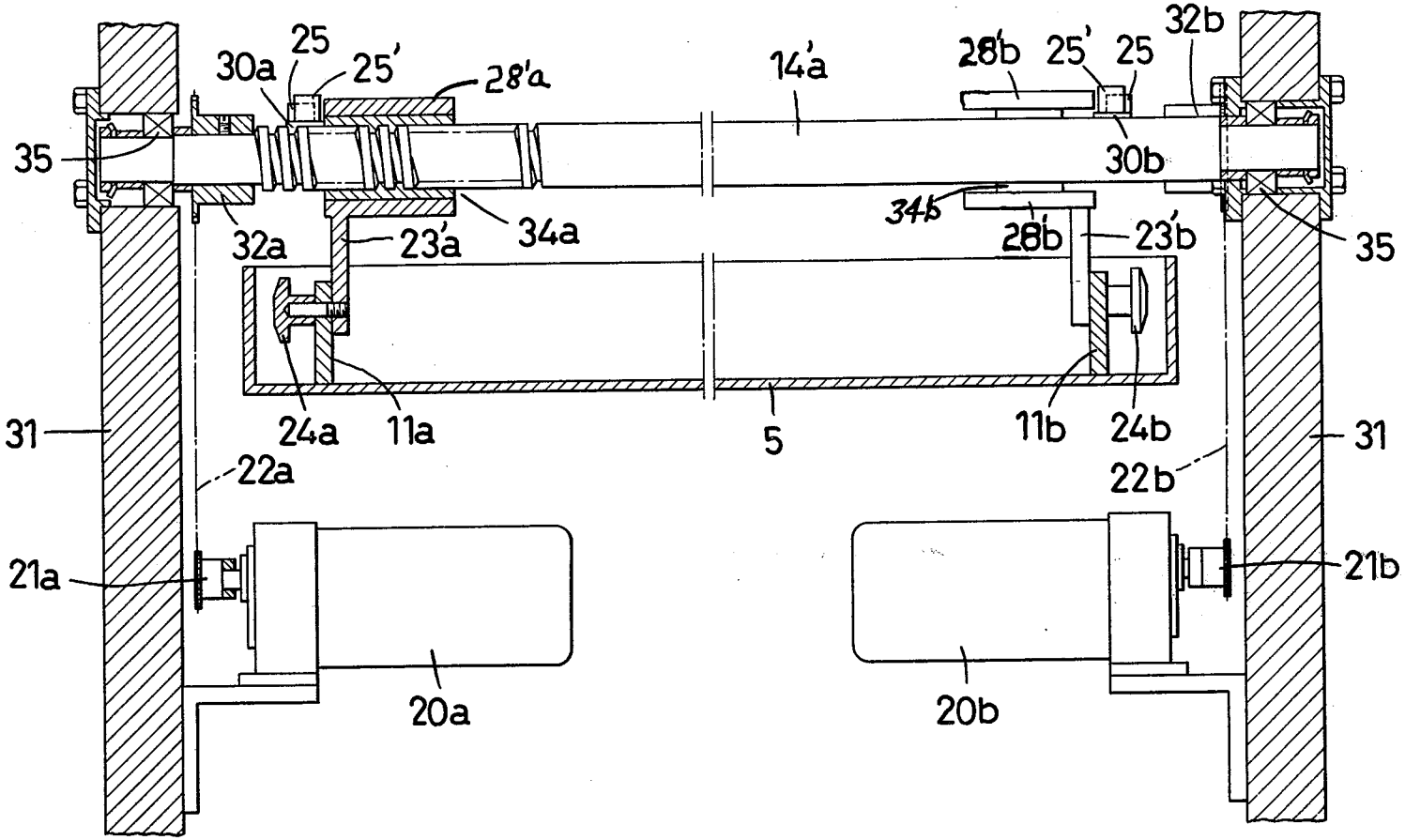

FIG. 5 is a cross-sectional view taken along the line V—V of FIG. 4.

Figure 1:
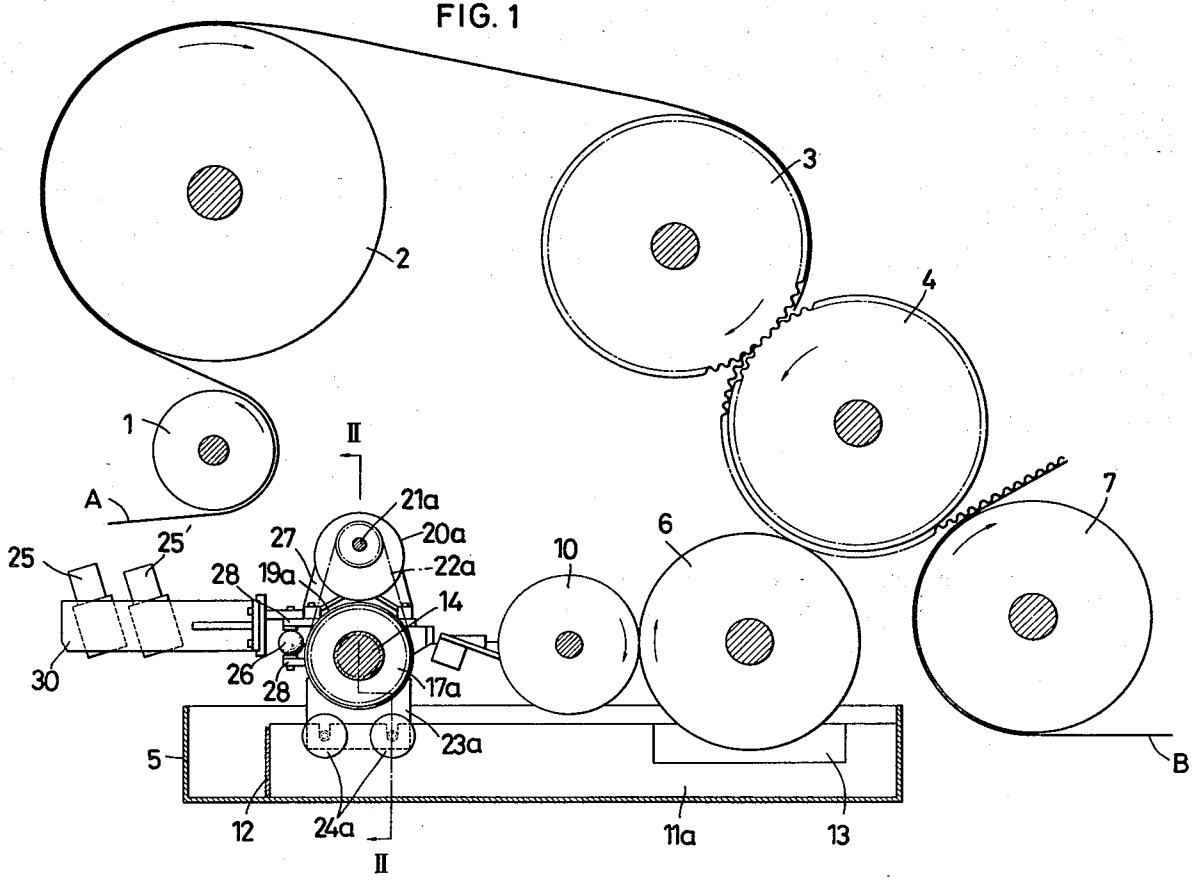
FIG. 1 is a schematic view of a first embodiment of this invention used with a corrugating machine.

Referring to FIG. 1, after passing around feed rolls 1 and 2, a liner A is corrugated as it passes between a pair of corrugating rolls 3 and 4. The corrugated liner A is then coated with glue on the peaks of its corrugations by a glue roll 6 partially immersed in a glue pan 5 and has another liner B adhered thereto by a press roll 7 around which the liner B runs. A doctor roll 10 is provided to adjust the amount of glue applied to the glue roll 6.

Two dams 11*a* and 11*b* are provided parallel to each other in the glue pan 5 and the glue roll 6 is rotatably mounted transversely above these dams. A weir 12 is provided at one end of each dam. The glue roll 6 is in contact with the dams 11*a* and 11*b* at portions 13 of the dams, which portions are made of an abrasion-proof material such as "Teflon".

Figure 2:
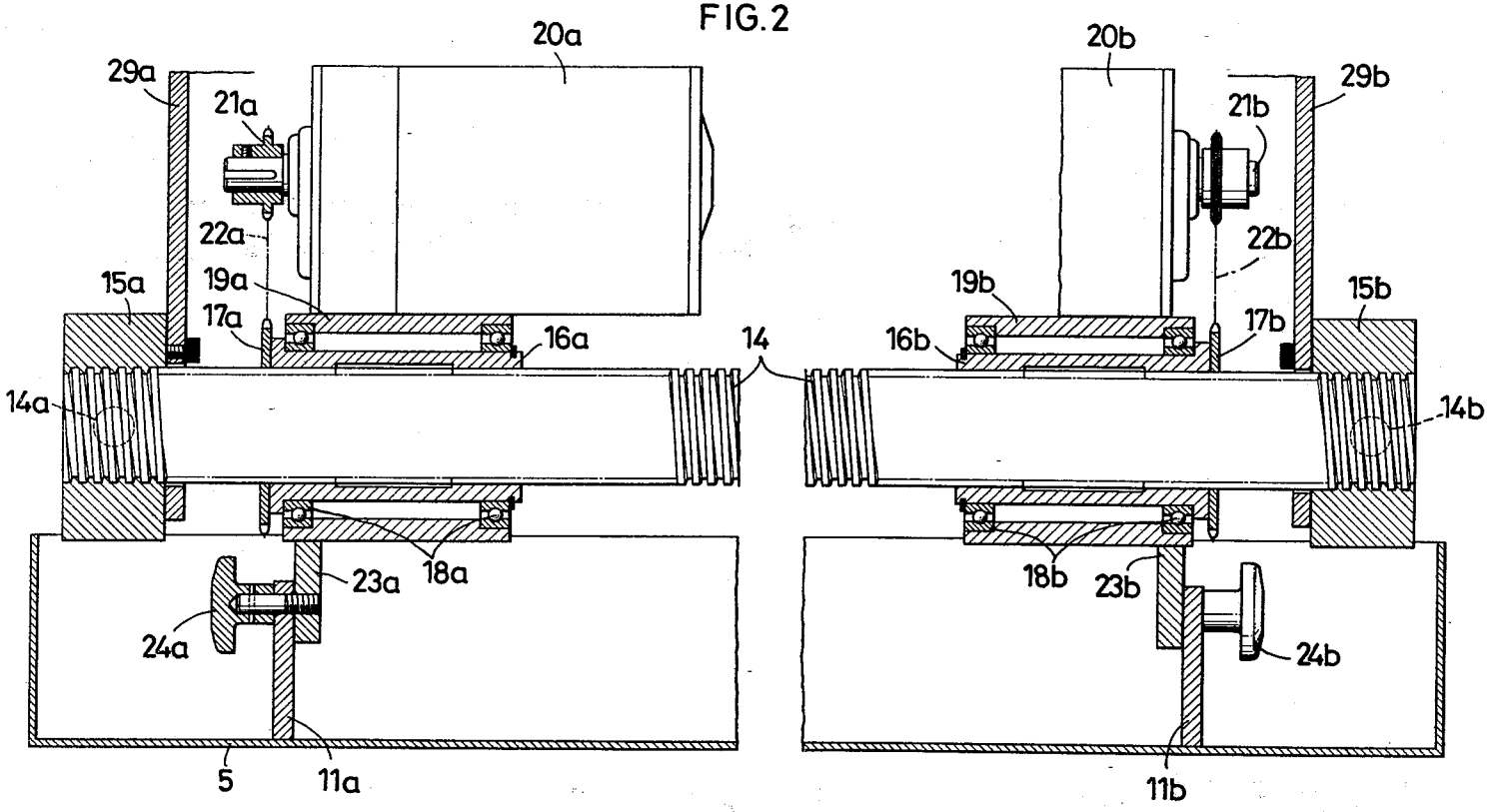
FIG. 2 is a cross-sectional view taken along the line II—II of FIG. 1.

Referring now to FIG. 2, a threaded shaft 14 is provided above the dams 11*a* and 11*b* extending parallel with the glue roll 6. The shaft 14 has its two ends threaded into fixing members 15*a* and 15*b*, respectively, secured to the machine frame. The shaft 14 is prevented from rotating by lock pins 14*a* and 14*b* at each end extending through the fixing members and the shaft itself.

Above the two dams are provided tubular movable members 16*a* and 16*b*, respectively, which are threadedly mounted on the shaft 14 and which have sprocket wheels 17*a* and 17*b* secured thereto at their outer ends, respectively. Tubular motor bases 19*a* and 19*b* are mounted on the movable members 16*a* and 16*b*, respectively, through ball bearings 18*a* and 18*b*. These motor bases serve also as bearing holders. On motor stands 27 on the motor bases 19*a* and 19*b* are fixedly mounted reversible motors 20*a* and 20*b* with a brake and a speed reducer. Two sliding plates 28 vertically spaced from each other extend horizontally from one side of each motor base and slidably engage a stationary bar 26 which extends parallel with the shaft 14 and is secured by brackets 29*a* and 29*b* to the fixing members 15*a* and 15*b* integral with the machine frame. The bar 26 serves as a guide for the motor bases 19*a* and 19*b* and prevents them from rotating.

The output shafts 21*a* and 21*b* of the reversible motors are coupled with the sprocket wheels 17*a* and 17*b* by chains 22*a* and 22*b*, respectively. Projections 23*a* and 23*b* extending downwardly from the bottom of the motor bases 19*a* and 19*b* are secured to the dams 11*a* and 11*b* by screws 24*a* and 24*b*, respectively. In other words, the two reversible motors 20*a* and 20*b* are mounted above the shaft 14 integral with the dams 11*a* and 11*b*, respectively.

The operation of the pair of the reversible motors 20*a* and 20*b* is controlled by detecting or following each edge of the running liner A by means of sensor means comprising a pair of photoelectric cells or photocells 25 and 25' mounted on a sensor holder 30 which is coupled with the associated motor base through the upper sliding plate 28. Thus, the motor, dam and photocells are integral with the motor base.

The dams can be driven by means somewhat different from that shown in FIGS. 1 and 2.

Referring to FIGS. 4 and 5, a pair of partially threaded shafts 14'*a* and 14'*b* are provided above the dams 11*a* and 11*b* and extending parallel to the glue roll 6. Both of the shafts have the ends thereof rotatably supported in bearings 35 secured to the machine frame 31.

A sprocket wheel 32*a* is fixedly mounted on one end of threaded shaft 14'*a* and a sprocket wheel 32*b* is mounted on the opposite end of the shaft 14'*b*. The sprocket wheels 32*a* and 32*b* are coupled by respective chains 22*a* and 22*b* to the shafts 21*a* and 21*b* of the reversible motors 20*a* and 20*b* which in this embodiment are secured to the machine frame 31. By this arrangement, the two threaded shafts 14'*a* and 14'*b* are driven from the respective motors 20*a* and 20*b* secured to the machine frame 31.

Nuts 34*a* and 34*b* threadedly engage the threaded portion of the shafts 14'*a*, and 14'*b*, respectively, so as to be movable along the shafts. The nuts 34*a* and 34*b* carry respective sensor holders 30*a* and 30*b* each having a pair of photocells 25 and 25' therein and having the projections 23'*a* and 23'*b* holding the respective dams 11*a* and 11*b* attached thereto. A pair of sliding plates 28'*a* extend from the nut 34*a* in a direction transverse to the shaft 14'*a* so as to slidably engage a flat portion of the other threaded shaft 14'*b* with the shaft disposed between the sliding plates. Similarly, a pair of sliding plates 28'*b* extend from the nut 34*b* and slidably engage the threaded shaft 14'*a*. Each of these sliding plates slide on the associated threaded shaft as the nut moves axially. They serve to prevent the nut from turning around the threaded shaft in which it is mounted.

Since each of the dams is controlled in the same manner, the following description relating to one will suffice for a full understanding.

As illustrated in FIG. 3(*a*), (*b*) and (*c*), the pair of photocells 25 and 25' are disposed at positions spaced slightly from each other near each edge of the running liner A. The associated dam and thus the photocells 25 and 25' integral therewith are controlled so that the photocells will be located in a position such as shown in FIG. 3(*a*). If both photocells are covered by the liner A as in FIG. 3(*b*), the photocells and thus the dam will be moved in the direction X. When they come back to the normal position of FIG. 3(*a*), the dam and the photocells will stop. If the liner A moves away from both photocells as in FIG. 3(*c*), the photocells and the dam will be moved in the reverse direction Y. Thus, generally, the smaller the distance between the photocells, the higher the detection accuracy.

The control circuit is adapted so that if the corrugating machine itself stops so that the web has stopped running or if the web has been cut by accident, the dams and the photocells integral therewith will be stopped immediately by an electrical interlock. When the web restarts, they will be unlocked automatically.

In the operation of the embodiment of FIGS. 1 and 2, when the photocells 25 and 25' detect the displacement of the liner A as described before to actuate the reversible motor 20*a*, the latter will start in the required direction. The rotation of the motor is transmitted through the chain 22*a* to the sprocket wheel 17*a* and thus the movable member 16*a* to which the sprocket wheel is secured. Since the shaft 14 is locked against rotation by the lock pins 14*a* and 14*b* at each end thereof, the movable member 16*a* will move transversely in one direction while turning on the shaft 14. This movement of the movable member 16*a* is transmitted to the motor base 19*a* mounted thereon through the ball bearings 18*a*. Since the motor base is inhibited from rotation by the bar 26, it moves with the movable member 16*a*, carrying the dam 11*a*, the reversible motor 20*a* and the photocells 25 and 25'.

In the embodiment of FIGS. 4 and 5, the rotation of two reversible motors 20*a* and 20*b*, which are not movable as in the first embodiment but fixed, is transmitted through the chains 22*a* and 22*b* to the threaded shafts 14'*a* and 14'*b*. As each shaft turns, the nut mounted thereon moves along the shaft since it is prevented from rotating around the shaft by the sliding plates sliding on the other threaded shaft. Since the dam is coupled with the nut, it will move with the nut.

In short, any displacement of either edge of the liner A in a crosswise direction is detected by a pair of photocells and in response to the signals from the photocells the dams 11*a* and 11*b* are moved in a direction so as to follow the displacement until the two photocells integral with the dams come back to a position where the liner edge is located between the two photocells.

It will be understood from the foregoing that this arrangement assures automatic control of the gluing width and position of the glue applied to the glue roll and thus the liner according to any change of width or position of the running liner. In other words, such a change in the width or position of the liner will be immediately followed by moving the dams by the corresponding distance in such a direction as to compensate for the change. This eliminates the possibility of inferior corrugated board being produced due to poor adhesion or smudging with glue because of application of glue to inappropriate portions of the glue roll.

Although in the preferred embodiments photoelectric cells are used as sensor means, they may be replaced with any other elements such as proximity sensors, pneumatic sensors, or limit switches. Also, although in the preferred embodiments a pair of sensors are used adjacent to each edge of the web, a single sensor may be used instead of two if it has in itself a dual function, that is, has one null zone sandwiched between two different sensing ranges. Particularly in the case of pneumatic sensors or limit switches, a single one on each side will suffice. Furthermore, a mark may be put beforehand on the web so as to be detected by sensor means.

Although in the preferred embodiments the sensors are integral with the associated motor and the dam, they need not be integral therewith. For example, a plurality of sensors may be fixedly mounted transversely so that the dams will be moved until the web edge is sensed by a particular sensor corresponding to a predetermined position of the web.

Although we have described this invention with reference to preferred embodiments which are applied to a glue roll on a corrugating machine, it will be understood that the present invention can be applied to other machines of a similar nature, such as an inking roll on a printer or a coating roll on a coating machine and that many changes or variations may be made within the scope and spirit of the present invention.

What is claimed is:

1. Apparatus for controlling the width and position of application of a liquid material such as glue or the like from a pan containing the material to a roll immersed in said pan so that the roll can apply the material to a running web, said apparatus comprising: a pair of dams for immersion in the material in said pan for confining the material in the pan between said dams, the roll being across said dams and extending below the level of the tops of the dams, said dams being movable in said pan in the direction of the length of said roll; sensor means for sensing any displacement of said running web laterally thereof or a change in the width thereof; a pair of reversible motors connected to said sensor means and actuated in response to the sensing by said sensor means of a displacement or change in width of the running web; and a threaded shaft and nut means coupled between each motor and a corresponding dam and said motors being connected thereto for producing relative rotation of said threaded shaft and nut means for moving the corresponding dam to a new position according to the displacement or change in width of the running web.

2. Apparatus as claimed in claim 1, in which said threaded shaft and nut means comprises: a fixed threaded shaft, a pair of movable members threadedly mounted on said shaft and coupled with the respective motors for being rotated for movement along said shaft, a pair of motor bases on the respective movable members and movable therewith along said shaft and supporting the respective motors thereon, and means engaged by said motor bases for permitting movement of the motor bases along said shaft and blocking rotation of the motor bases around said shaft, each of said dams being coupled with a corresponding motor base and being movable therewith.

3. Apparatus as claimed in claim 1 in which said threaded shaft and nut means comprises: a pair of rotatable threaded shafts coupled with the respective motors for being rotated thereby, said motors being fixed on said apparatus, and a pair of movable members threadedly mounted on said threaded shafts, said movable members each being movable along the corresponding threaded shaft as said shaft is rotated by the corresponding motor, means connected to said movable members for preventing them from turning around said threaded shafts, each of said dams being coupled with a corresponding movable member and being movable therewith.

4. Apparatus as claimed in claim 3 wherein said means preventing said movable members from turning around said threaded shafts comprises a pair of sliding plates on each movable member extending in a direction transverse to the shafts and slidably engaging the other threaded shaft.

* * * * *